US009610003B2

(12) United States Patent
Heidel et al.

(10) Patent No.: US 9,610,003 B2
(45) Date of Patent: Apr. 4, 2017

(54) DOMESTIC DISHWASHER WITH A SORPTION DRYING DEVICE AND CORRESPONDING METHOD

(75) Inventors: Andreas Heidel, Holzheim-Weisingen (DE); Bernd Kränzle, Dischingen (DE); Christian Wolf, Dillingen (DE)

(73) Assignee: BSH Hausgeräte GmbH, Munich (DE)

( * ) Notice: Subject to any disclaimer, the term of this patent is extended or adjusted under 35 U.S.C. 154(b) by 708 days.

(21) Appl. No.: 13/058,879

(22) PCT Filed: Aug. 7, 2009

(86) PCT No.: PCT/EP2009/060289
§ 371 (c)(1),
(2), (4) Date: Feb. 14, 2011

(87) PCT Pub. No.: WO2010/023088
PCT Pub. Date: Mar. 4, 2010

(65) Prior Publication Data

US 2011/0146718 A1 Jun. 23, 2011

(30) Foreign Application Priority Data

Aug. 27, 2008 (DE) ..... 10 2008 039 888
Nov. 10, 2008 (DE) ..... 10 2008 056 580

(51) Int. Cl.
*A47L 15/00* (2006.01)
*A47L 15/46* (2006.01)
*A47L 15/48* (2006.01)

(52) U.S. Cl.
CPC ..... *A47L 15/481* (2013.01); *A47L 15/0034* (2013.01); *A47L 15/0049* (2013.01); *A47L 15/46* (2013.01); *A47L 2401/18* (2013.01); *A47L 2401/30* (2013.01); *A47L 2501/11* (2013.01); *A47L 2501/12* (2013.01)

(58) Field of Classification Search
CPC .. A47L 15/0034; A47L 15/0049; A47L 15/46; A47L 15/481; A47L 2401/18; A47L 2401/30; A47L 2501/11; A47L 2501/12
USPC ..... 134/58 D
See application file for complete search history.

(56) References Cited

U.S. PATENT DOCUMENTS 3,378,933 A 4/1968 Jenkins
4,641,671 A * 2/1987 Nogi et al. ..... 134/57 D
4,756,321 A * 7/1988 Livingston et al. ..... 134/56 D
6,149,732 A * 11/2000 Carlisle ..... 134/6
2003/0084928 A1 * 5/2003 Wood ..... 134/58 D
(Continued)

FOREIGN PATENT DOCUMENTS

DE 8026939 U1 3/1982
DE 10058188 * 5/2002 ..... A47L 15/48
(Continued)

OTHER PUBLICATIONS

English Translation DE10058188.*
(Continued)

*Primary Examiner* — Michael Barr
*Assistant Examiner* — Levon J Shahinian
(74) *Attorney, Agent, or Firm* — Michael E. Tschupp; Andre Pallapies

(57) ABSTRACT

A domestic dishwasher is provided, which has a main controller, a sorption drying device, and an additional controller to specifically control an electrical component of the sorption drying device.

20 Claims, 3 Drawing Sheets

(56) References Cited

U.S. PATENT DOCUMENTS

| | | | | |
|---|---|---|---|---|
| 2006/0278257 | A1* | 12/2006 | Jerg et al. | 134/56 D |
| 2007/0101609 | A1 | 5/2007 | Jerg et al. | |
| 2007/0107754 | A1* | 5/2007 | Jeong et al. | 134/58 D |
| 2007/0163626 | A1* | 7/2007 | Klein | 134/56 D |
| 2007/0295360 | A1 | 12/2007 | Jerg et al. | |
| 2007/0295373 | A1 | 12/2007 | Jerg et al. | |
| 2008/0083433 | A1 | 4/2008 | Jerg et al. | |
| 2008/0092933 | A1* | 4/2008 | Tameishi et al. | 134/133 |
| 2008/0149142 | A1 | 6/2008 | Jerg et al. | |
| 2008/0295875 | A1 | 12/2008 | Jerg et al. | |

FOREIGN PATENT DOCUMENTS

| | | | |
|---|---|---|---|
| DE | 10058188 | A1 | 5/2002 |
| DE | 10353774 | A1 | 2/2005 |
| DE | 10353577 | A1 | 6/2005 |
| DE | 202008011159 | U1 | 11/2008 |
| EP | 0358279 | A1 | 3/1990 |
| WO | 2007074106 | A1 | 7/2007 |

OTHER PUBLICATIONS

Report of Examination including National Search Report CN 20098013397.5 dated Nov. 9, 2012.
International Search Report PCT/EP2009/060289 dated Jul. 8, 2010.
Report of Examination DE 10 2008 039 888.8 dated May 18, 2010.
European Search Report EP 13 15 6887 dated Apr. 25, 2013.

* cited by examiner

DOMESTIC DISHWASHER WITH A SORPTION DRYING DEVICE AND CORRESPONDING METHOD

BACKGROUND OF THE INVENTION

The invention relates to a domestic dishwasher with a main control device and with at least one sorption drying device.

In a domestic dishwasher with a sorption drying system such as the dishwasher of DE 10 3535 77 A1 for example, in the "drying" subprogram step of the respective dishwashing program of the dishwasher for drying dishes, moist-hot air is conveyed continuously by means of a fan out of the washing container of the dishwasher through the sorption column of the sorption drying device. During this process moisture is removed from the air guided therethrough by the reversibly dehydratable drying material of said sorption column through condensation. The air dried in this way is fed back into the washing container where it is reloaded with moisture from the moist-hot air present there and fed back again into the circulation system of the sorption drying device. For regeneration, i.e. desorption, of the reversibly dehydratable sorption drying material of the sorption column for re-use in the dry state for the next drying stage of a subsequent dishwashing program, said material is heated by means of a heating device to temperatures high enough to enable the water stored in the sorption material to escape as completely as possible as water vapor and to enable it to be blown by means of an air flow generated by the fan into the washing container. The air heated up by this desorption can be used additionally to warm or to heat a washing liquor, air and/or items to be washed in at least one washing cycle and/or cleaning cycle of a newly-started dishwashing program through the warm air flow generated in the respective desorption cycle. This makes it possible to clean and dry items to be washed in an energy-efficient manner.

In practice high demands are made on the secure functioning of this type of sorption drying system of a dishwasher in order to enable trouble-free operation of the dishwasher over a desired product lifetime.

BRIEF SUMMARY OF THE INVENTION

The underlying object of the invention is to demonstrate a way in which the functions of at least one sorption drying device of a domestic dishwasher can be operated largely securely in a simple manner. This object is achieved for a domestic dishwasher of the type stated at the outset by an additional control unit being provided in addition to the main control device for specific control of at least one electrical component of the sorption drying device.

The fact that at least one additional control unit is provided for the sorption drying device in addition to the main control device of the domestic dishwasher means that it is possible to control or to set the sorption drying device in a functionally secure manner for the respective sorption and/or desorption process. This is because the separately provided additional control unit for at least one electrical component of the sorption drying device enables specific requirements for reliable operating states of the one or more electrical components of the sorption drying device to be better supervised and/or implemented. In particular with the aid of the additional control unit the specific interplay of the one or more operating parameters of the one or more electrical components of the sorption drying device can be tailored to one another such that the sorption drying device can be operated securely during its respective sorption process and/or desorption process in a desired, permitted operating range.

In this way the functional security and/or functional integrity of the sorption drying device over the desired overall product lifetime of the dishwasher can be maintained for the respective sorption process and/or desorption process in a simple and reliable manner.

In accordance with a first useful development the additional control unit can be a component of the main control device. This means that a high level of integration can be ensured so that the main control device with the additional control unit only occupies a small space in the domestic dishwasher. In particular it can be useful to implement the additional control unit in a separate logic module or in an existing logic module of the main control device. This allows communication links between the logic functions of the additional control unit and the logic functions of the main control device to be made simply and reliably during manufacturing. Since the main control device is preferably arranged in a protected mounting location in the dishwasher, the additional control unit can also be accommodated there in a secure manner so that unnecessary installation outlay and additional measures, especially to counteract any contact with moisture or liquid during leaks that may occur from the washing container or the fluid circulation system of the dishwasher are largely avoided.

As an alternative, in accordance with a useful development of the invention, it can be especially advantageous for the additional control unit to be embodied as a separate functional component and to be arranged spatially separated from the main control device. This advantageously enables the functional safety for the additional control unit, which is responsible for the one or more electrical components of the sorption drying device, to be enhanced, should there be an error in the main control device. Conversely the main control device is able to be decoupled from the additional control unit so that it can continue to execute the operating functions assigned to it without difficulties, and can do so even if the additional control unit fails or malfunctions in some other way. In particular, if the additional control unit is accommodated at a different location from the main control device in the domestic dishwasher, functional security is able to be largely ensured both for the main control device and the additional control unit.

It is especially useful for the additional control unit to be arranged spatially removed by a prespecified minimum distance from the sorption drying device. This minimum distance to be maintained enables impermissibly high thermal stresses on the additional control unit which can occur through the thermal heating of sorption drying material in the sorption container of the sorption drying device by at least one heating device to be largely avoided in a reliable manner. Its functionally secure operation is thus guaranteed.

In particular it can be useful to accommodate the main control device and/or the additional control unit in a base module below the base of the washing container. A dry area to accommodate the units is provided there which is protected, especially protected from moisture or spray water, so that an adverse effects on or damage to the main control device and/or the additional control unit are largely avoided. It can also be useful to likewise accommodate the sorption container of the sorption drying device, at least one heating device and/or fan unit assigned to the sorption container below the base of the washing container in the base module. This enables cabling between these different electrical components and the additional control unit and/or the main control device to be simplified.

In accordance with a further useful development of the invention the additional control unit is assigned to a heating device and/or a fan unit of the sorption drying device for supervision and/or setting of at least one operating parameter. This especially enables functionally secure operation of the sorption drying device to be largely ensured during the respective sorption and/or desorption process. The additional control unit especially allows specific checking of the heating device and/or the fan unit of the sorption drying device.

It can especially also be useful for the additional control unit for the heating device and/or the fan device of the sorption drying device to have an on/off switching function. This enables thermal overloads of the additional control unit as a result of the development of heat during the respective desorption process to be largely avoided if the additional control unit switches off the heating device and/or the fan unit of the sorption drying device when an error or a fault or an interruption in the communication link between the main control device and the additional control unit occurs, and/or when an upper temperature limit in the washing container and/or in the area of the sorption container is exceeded.

In accordance with a further useful development of the invention the additional control unit is connected to the main control device via at least one control line, especially a data bus. This makes it possible to merely provide an on and/or off switching function for the heating device and/or the fan device of the sorption drying device in the additional control unit, while the actual control functions for the respective sorption operation and/or desorption operation of the sorption drying device are implemented during the respective execution of the dishwashing program in the control logic of the main control device. In particular this allows specific functions of the additional control unit to be supervised and/or checked and/or determined by means of the main control device in a simple and reliable manner.

In accordance with a further useful development of the invention the additional control unit has watchdog supervision logic, i.e. a dead man supervision logic with which the functional integrity of the control line is able to be checked during activation of the sorption drying device for the respective sorption drying process and/or desorption process. This watchdog supervision logic enables detection in a simple and reliable manner of the presence of an error or a fault or even an interruption on the control line and thus the communication link between the main control device and the additional control unit. If an error is present, it is then made possible for the additional control unit in advantageous manner to switch off the one or more components, such as the heating device and/or fan unit of the sorption drying device for example. In particular the additional control unit ensures that the heating device of the sorption drying device is switched off if an error on the control line has been detected by its watchdog supervision logic. This reaction of the additional control unit especially serves to provide a thermal failsafe function for the sorption drying device by electrical means. The fact that the heating device is put into the switch-off state by the additional control unit means that especially the respective desorption process cannot be continued, i.e. a further heating of the heating device and thus a further heating of the sorption material in the sorption container of the sorption drying device can be automatically stopped by the additional control unit in an advantageous manner. The additional control unit can thus autonomously, i.e. independently of the main control device, interrupt the heating process of the sorption material during desorption in the event of a fault or an error or an interruption on the control line. This is because in this case it would no longer be at all possible for the main control device to send a switch-off command by means the control signal to the additional control unit over the control line which would still arrive correctly at the additional control unit. With the aid of the additional control unit it is thus ensured in each case that at least the heating device and if necessary the associated fan device are switched off during a desorption process or a desorption process is not started at all if a communication error and/or an interruption is detected on the control line by the watchdog supervision logic of the additional control unit. In this way the additional control unit provides a simple and reliable protective measure against an impermissibly high heating up of the sorption material in the sorption container of the sorption drying device and/or against overheating of its assigned heating device. In this way in particular thermal material damage or impermissible material stressing of the sorption material as a result of impermissibly high temperatures can be avoided. Furthermore the heating device is also protected from impermissible thermal stresses or damage through overheating. Impermissible thermal stresses on or even damage to components in the environment of the heating device and/or of the sorption container of the sorption drying device are also largely avoided. Finally the premature aborting of the ongoing desorption process by switching off the heating device enables any danger of fire to be excluded. In addition to or independently of the switching off of the heating device it can be useful also to shut down further components of the sorption drying device, such as its fan unit for example, if the watchdog supervision logic of the additional control unit registers the occurrence of an error.

In particular it can be useful for the watchdog supervision logic of the additional control unit, for supervision of the functional integrity of the control line, to the switch to active if the heating device of the sorption device is switched on for desorbing its sorption material. The same advantageously applies in advance of an imminent desorption process if the program sequence logic in the main control device wants to initiate a desorption process as the next program sequence step. The heating device and if necessary the fan device are then no longer switched on by the additional control electronics.

In accordance with a further useful development of the invention, the main control device sends a plurality of switch-on commands over the control line to the watchdog supervision logic of the additional control unit. In particular the main control device transfers a switch-on command repeated cyclically at a prespecified time interval. This advantageously makes it possible to monitor the control line itself continuously in a checking period before the start of an imminent desorption process and/or especially during the desorption process. In such cases the watchdog supervision logic of the additional control unit usefully monitors the exceeding of a prespecified clock time or wait time since the detection of the respective switch-on command sent. In particular the watchdog supervision logic of the additional control unit has a clock or timer unit for this purpose which defines an upper limit for the wait time between the receive points of two switch-on commands sent consecutively. This enables it to monitor in a simple manner whether an upper limit for the wait time has been exceeded without receipt of a next switch-on command. In particular the additional control unit switches off at least one electrical component, especially the heating device and/or if necessary the fan device of the sorption drying device if it is established by the watchdog supervision logic that the upper limit for the wait time without receipt of a next switch-on command has been exceeded.

In accordance with a further useful development of the invention the watchdog supervision logic of the additional control unit is especially switched to active for supervision of the functional integrity of the control line if the heating device of the sorption drying device is switched on for desorbing its sorption material.

If it is established by the watchdog supervision logic that the prespecified upper limit for the wait time or clock time has been exceeded without detection of the respective switch-on command, it independently, i.e. automatically, switches off the heating device of the sorption drying device. In addition the additional control unit can usefully also switch off the fan unit of the sorption drying device in this case.

In accordance with a further useful development of the invention it may be useful for the additional control unit to switch off the fan unit of the sorption drying device after a switch-off time of the heating unit only after a prespecifiable run-on time has elapsed. The fact that the fan unit also continues to run after the switch off time of the heating device for a prespecifable length of time enables the heating device and/or the sorption material in the sorption container of the sorption drying device to have air still flowing through them. This continued passage of air enables heat to be transported away from the heating device and/or out of the sorption container, so that overheating in the area of the heating device and/or of the sorption container is largely avoided. This continued operation of the fan unit is especially advantageous because desorption material during its heating-up process reacts slowly during the desorption because of its heat storage capacity and stores heat. The fan unit therefore usefully continues to be operated beyond the switch-off time of the heating device until such time as sufficient heat energy has been transported away from the sorption material and the sorption material by the continued passage of air, so that material damage to the sorption material, impermissible stresses on the heating device and on the other components of the sorption container as well as on components or elements of the dishwasher surrounding the sorption container are largely avoided. The continued air circulation by means of the fan unit ensures that cooling of the sorption material in the sorption container and/or the heating device is accelerated. Without the fan unit running on there could in fact be a buildup of heat in the sorption container which could lead to impermissibly high temperatures.

In accordance with a further useful development of the invention the main control device can also issue a switch-off instruction to the additional control device to switch off the sorption drying device, especially its heating device and/or fan unit, if a critical limit temperature is exceeded in the interior of the washing container of the domestic dishwasher and/or in the area of the sorption container of the sorption drying device. This provides a further thermal failsafe facility, especially during desorption operation of the sorption drying device. The temperature in the interior of the washing container can be determined for example with the aid of at least one temperature sensor which is accommodated for example on one of the side walls of the washing container of the dishwasher. In a corresponding manner the respective temperature in the area of the sorption container can be determined with the aid of at least one temperature sensor.

In accordance with a further useful development of the invention the additional control unit can switch off the sorption drying device, especially its heating device and/or fan unit, if a critical characteristic value, especially mains voltage fluctuation and/or mains frequency fluctuation of the electrical energy supply network to which the main control device and/or the additional control unit is effectively connected, is exceeded. This also safeguards the sorption drying device against any impermissibly high fluctuations from one or more characteristic values of the electrical energy supply network. In particular it can be ensured in this way, in the event of an impermissibly high overvoltage for example, that the heating facility is switched off before said facility outputs too much heat to the sorption material of the sorption container as a result of this overvoltage.

Expressed in more general terms, the additional control unit thus enables it to be ensured that impermissibly high heating of the sorption material in the sorption container of the sorption drying facility is largely avoided. In particular exceeding a critical limit temperature, which would lead to damage to the sorption material is prevented. In this way it is ensured that the sorption material is only heated up by the heating device in a manner that preserves the material. In this way irreparable damage to the material is largely avoided.

The invention also relates to a method for controlling the sorption drying device of a domestic dishwasher comprising a main control device, which is characterized in that at least one component of the sorption drying device is controlled by least one additional control unit which is provided in addition to the main control device.

Other developments of the invention are described in the subclaims.

BRIEF DESCRIPTION OF THE DRAWINGS

The invention and its developments and their advantages will be explained in greater detail below with reference to drawings, in which.

DETAILED DESCRIPTION OF EXEMPLARY EMBODIMENTS OF THE PRESENT INVENTION

Figure 1:
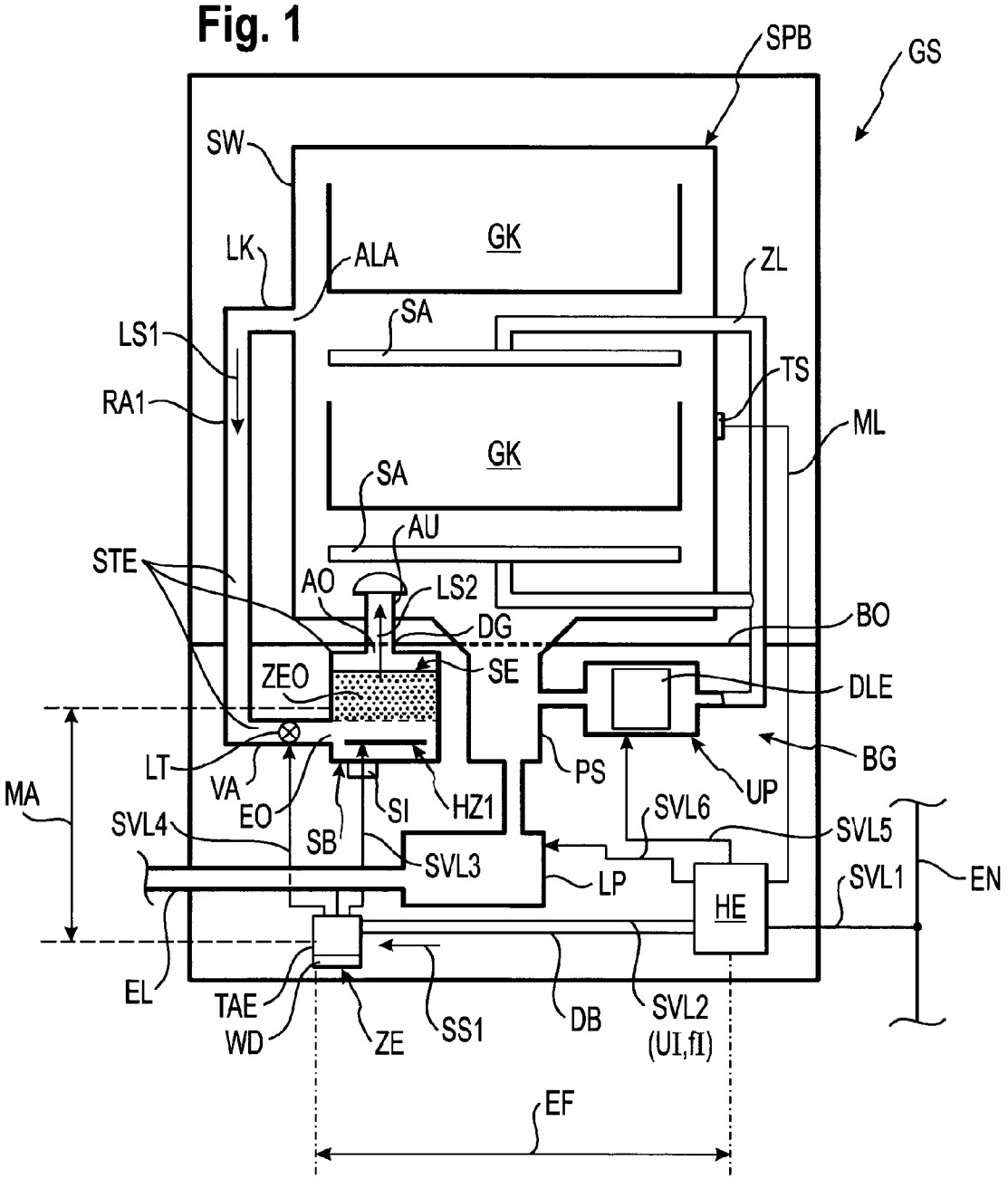
FIG. 1 shows in a schematic representation an exemplary embodiment of an inventively embodied dishwasher which, in addition to a main control device, comprises an additional control unit connected to the latter via at least one control line.

Elements with the same function and mode of operation are provided with these same reference characters in each case in FIGS. 1 through 4.

FIG. 1 shows in a schematic representation a domestic dishwasher GS as an exemplary embodiment of an inventively embodied domestic appliance. As its main components it has a washing container SPB, a base module BG arranged therebelow and also a sorption drying facility STE as an air drying facility. The sorption drying facility STE is preferably provided externally, i.e. outside the washing container SPB, partly on a side wall SW and also partly in the base module BG. As its main components it includes at least one air-guiding channel LK with at least one fan unit or a blower LT inserted into the latter and also at least one sorption container SB with sorption drying material ZEO, especially zeolite or the like. The washing container SB preferably accommodates one or more mesh baskets GK for receiving and for washing items, such as crockery for example. One or more spray devices such as e.g. one or more rotating spray arms SA are provided in the interior of the washing container SPB for spraying the items to be cleaned with a liquid. In the exemplary embodiment here, both a lower spray arm and an upper spray arm are suspended to allow them to rotate in the washing container SPB.

To clean items to be washed, dishwashers run through wash programs which comprise a plurality of program steps. The respective wash program may comprise in particular the following individual program steps running consecutively over time:

- at least one prewash step for removing coarse soiling by means of fresh water and/or sufficiently clean used water,
- at least one subsequent cleaning step with cleaning agent added to the washing liquor fluid, especially water,
- at least one subsequent intermediate wash step,
- at least one subsequent final rinse step with the application of liquid, especially water, mixed with wetting agents, especially rinsing agents, as well as a final drying step in which the cleaned items to be washed are dried.

Depending on the wash cycle or cleaning step of a selected dishwashing program, fresh water and/or used water mixed with detergent are applied to the items to be washed in each case, e.g. for a cleaning cycle, for an intermediate wash cycle and/or for a final rinse cycle. Here in the exemplary embodiment the respective liquid used is referred to as washing liquor.

The fan unit LT and the sorption container SB are accommodated in the exemplary embodiment here in the base module BG underneath the base BO of the washing container SPB. The air-guiding channel LK runs from an outlet opening ALA which is provided above the base BO of the washing container SPB in a side wall SW thereof, externally on this side wall SW with an inlet-end tube portion RA1 down to the fan unit LT in the base module BG. The outlet of the fan unit LT is connected by means of a connecting section VA of the air-guiding channel LK to an inlet opening EO of the sorption container SB in a region thereof close to the base. The outlet opening ALA of the washing container SPB is arranged above the base BO thereof at such a height that the intrusion of washing liquor fluid or cleaner foam is largely avoided during the respective washing step or cleaning step.

The fan unit is preferably embodied as an axial fan. It serves to force moist hot air LS1 to flow out of the washing container SPB through a sorption unit SE in the sorption container SB. The sorption unit SE contains reversibly dehydratable sorption material ZEO which can absorb and store moisture from the air LS2 guided through it. The sorption container SB has in the area close to the top of its housing on the upper side an outlet opening AO which is connected via an outlet element AU, especially an outflow connecting piece, through a through-insertion opening DG in the base BO of the washing container SPB to the interior thereof. In this way moist-hot air LS1 can be sucked in during the drying step of the respective dishwasher program for drying cleaned items to be washed from the interior of the washing container SPB through the outlet opening ALA by means of the switch-on fan unit into the air-guiding channel LK and transported via the tubular connecting section VA between the fan unit and the sorption container into the interior of the sorption container SB for forcing air to flow through the reversibly dehydratable sorption material ZEO in the sorption unit SE. The sorption material ZEO in the sorption unit SE extracts water from the moist air flowing through it such that downstream of the sorption unit SE dried air can be blown via the outlet element or exhaust element AUS into the interior of the washing container SPB. In this way, this sorption drying facility STE provides a closed air-circulation system.

At least one heating device HZ1 for desorption and thus regeneration of the sorption material ZEO is arranged in the sorption container SB upstream of the sorption unit SE thereof, viewed in the direction of flow. The air heating device HZ1 serves in this case to heat air LS1 which is conveyed by means of the fan unit LT via the air-guiding channel LK into the sorption container SB and in said container is blown through the sorption material ZEO of the sorption unit SE. As it flows through the sorption material ZEO, this forcibly-heated air LS2 accepts moisture, especially water, from the sorption material ZEO that has been deposited in said material previously in a preceding drying step during execution of a dishwasher program. This water, which is expelled from the sorption material ZEO, is transported by the heated air via the outlet element AUS of the sorption container SB into the interior of the washing container. This desorption process preferably takes place when the warming or heating of the washing liquor fluid is required at the beginning of a washing cycle, especially a prewash cycle, and/or during the subsequent cleaning cycle of a subsequent dishwasher program. This is because the air heated for the desorption process by the air heating device HZ1 can advantageously simultaneously be included for heating up the washing liquor fluid in the washing container SPB, for heating its internal walls and/or the items to be washed in the washing container, which saves energy. The heating of the respective washing liquor fluid can if necessary be undertaken solely with the sorption drying device by desorption in such cases.

The dishwasher GS also has a pump sump PS in the base BO of its washing container SPB which includes a filter system. The pump sump OS is used to collect washing liquor which is sprayed out during the respective washing cycle from the spray arms. The pump sump PS is connected via a pipe system ZL to the upper and the lower spray arm SA. In this case a circulation pump UP is provided in the connecting area of the pump sump PS which feeds the washing liquor fluid from the pump sump PS into the supply lines of the pipe system ZL. A suction or drain pump LP is also connected to the pump sump PS with which used washing liquor fluid can be pumped away from the pump sump PS partly or completely into a waste water line EL.

To heat the washing liquor a continuous-flow heater DLE or a heat exchanger may be provided in the pipe system ZL here in the exemplary embodiment in the circulation pump UP as an additional fluid heating facility for the sorption drying facility STE. The respective washing liquor fluid can be heated up by it in addition to or independently of the desorption heating process of the desorption drying device. The circulation pump UP and also the continuous-flow heater DLE are respectively supplied jointly or separately from one another with electrical energy via at least one electrical energy supply line SVL5 from a main control device HE. In particular the electrical energy supply line SVL5 comprises at least one first power supply line as a live phase and at least one second power feed line as a neutral conductor. The drain pump LP is also connected to the main control device HE in a similar manner to the circulation pump UP via a power supply line SVL6. The main control device HE is connected via a mains energy supply line SVL1 to the public energy supply network EN. It switches the energy supply line SVL5 through to the continuous-flow heater DLE and/or the circulation pump UP if warming or heating of washing liquor is required for the respective washing cycle or cleaning cycle and switches the latter off if no warming of washing liquor is required. In a similar manner the main control device HE switches on the suction or drain pump LP if, in a washing or cleaning step, there is a request from the main control device HE for used washing liquor fluid to be pumped away out of the pump sump PS partly or completely into the waste water line EL.

In FIG. 1 an additional control device ZE is provided in the base module BG in addition to the main control device HE, which is used for controlling or supervision and also supplying energy to the fan unit LT and the air heating unit HZ1 of the sorption drying facility STE. For this purpose the additional control device ZE is connected via an energy supply line SVL2 to the main control device HE. In addition the additional control device ZE is controlled by the main control device HE via at least one bus line or signal line DB. From the additional control device ZE at least one energy supply line SVL3 is routed to the heating device HZ1 of the sorption container SB. It includes especially at least one first power supply line as an active phase and also at least one second power supply line as a neutral conductor. The additional control device ZE also controls the fan unit LT via a control line SLV4. A power supply line for the fan unit LT can especially also be integrated into the control line SLV4.

The additional control unit ZE is thus embodied as a separate function component here and is spatially separated from the main control device by a distance EF. This advantageously enables the functional safety for the additional control unit to be enhanced which is responsible for the one or more electrical components of the sorption drying device should there be an error in the main control device. Conversely the main control device is able to be decoupled from the additional control unit so that it can continue to execute the operating functions assigned to it without difficulties, and can do so even if the additional control unit fails or malfunctions in some other way. Here in the exemplary embodiment of FIG. 1 the additional control unit is accommodated at a different location in the domestic dishwasher from the main control device. This enables the functional security to be largely ensured both for the main control device and also for the additional control unit.

Furthermore the additional control unit ZE is arranged spatially removed by a prespecified minimum distance MA from the sorption container SB of the sorption drying device STE. This minimum distance to be maintained allows impermissibly high thermal stresses on the additional control unit which can occur through the thermal heating of sorption drying material in the sorption container of the sorption drying facility by at least one heating device to be largely avoided in a reliable manner. Its functionally secure operation is thus guaranteed.

As soon as a drying process by means of the sorption drying facility STE is now required at the conclusion of a dishwashing program, the main control device HE transfers via the control line DB a control signal SS1 to the additional control device ZE to the effect that this switches on the fan unit LT via the control line SLV4, so that moist-hot air is sucked out of the washing container into the air-guiding channel LK and can be supplied to the sorption container SB for drying.

As soon as the main control device HE has initiated a desorption process in each case, said device communicates by means of the control signal SS1 to the additional control device ZE that the heating device HZ1 of the sorption container SB as well as the fan unit LT are to be switched on by the latter. The additional control unit ZE then switches on these two electrical components HZ1, LT of the sorption drying device STE.

Figure 2:
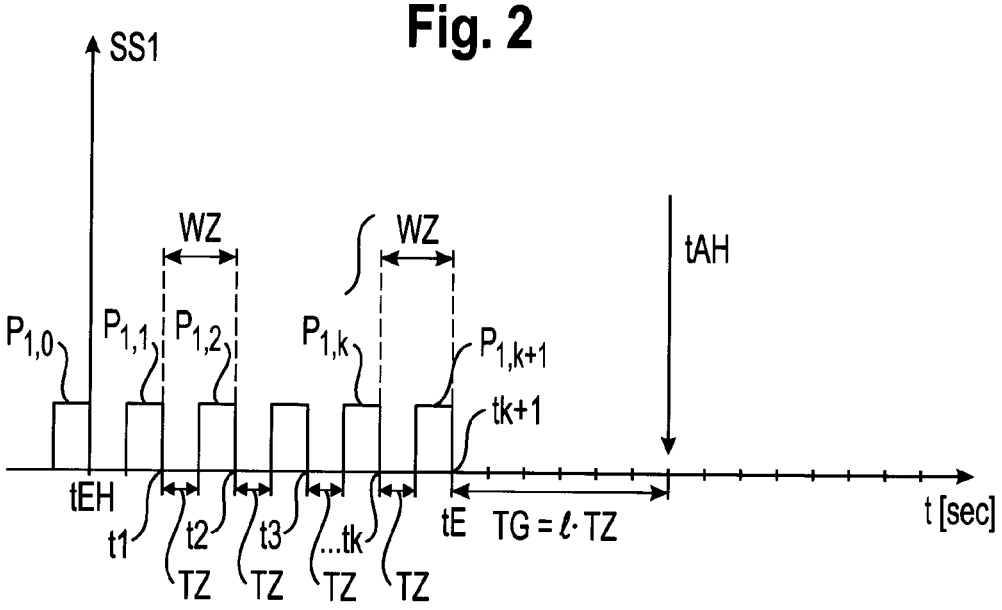
FIG. 2 shows in a schematic representation a diagram to illustrate the watchdog supervision of the control line between the additional control unit and the main control device of the dishwasher of FIG. 1.

In order to monitor the functional integrity of the control line DB, i.e. in particular to be able to detect a communication error or an interruption of the control line DB, the additional control device ZE has a type of dead man supervision logic or watchdog supervision logic. This is especially activated if a desorption process is planned by the program sequencing logic of the main control device HE or if a desorption process has already been started by the latter. The main control device HE then transmits a plurality of switch-on commands at defined intervals or pauses over the control line DB to the additional control unit ZE. In particular the main control device transmits at constant intervals TZ the same switch-on command P1 over the control line DB to the additional control unit ZE cyclically repeated. This is illustrated in FIG. 2. Plotted along the abscissa is the time t in seconds (sec) while the progress over time of the control signal SS1 is assigned to the ordinate. At the point in time tEH the additional control unit ZE detects by means of its watchdog supervision logic WD a falling edge of the first switch-on command $P_{1,0}$ arriving from the main control device HE. It then switches the heating device HZ1 on in order to start the desorption process required by the main control device. During this desorption process the main control device HE sends further switch-on commands $P_{1,1}$, $P_{1,2}$, $P_{1,3}$, . . . $P_{1,k+1}$ as defined constant time intervals WZ from one another, i.e. the ongoing switch-on commands each have for example with regard to their falling edges a time interval or a clock time as wait time WZ. The watchdog supervision logic WD of the additional control unit ZE has a clock or timer unit TAE for this purpose which defines an upper limit TG for the wait time WZ between the receive clock times such as tk, tk+1 for example for each two consecutively sent switch-on commands, such as $P_{1,k}$, $P_{1,k+1}$ for example. Between the falling edge of the respective switch-on command such as $P_{1,k}$ and the rising edge of the respective following switch-on command $P_{1,k+1}$ there is a prespecified pause time or dead time in this case. While the watchdog supervision logic WD is receiving these switch-on commands $P_{1,0}$ to $P_{1,k+1}$ in the predetermined temporal trigger grid, it classifies the control line DB as functioning correctly. If however an upper limit TG is exceeded for the prespecified clock time or wait time WZ between two consecutive switch-on commands in each case such as $P_{1,k}$, $P_{1,k+1}$, without the watchdog supervision logic WD detecting a switch-on command P1, the watchdog supervision logic interprets this as an error, i.e. as a fault of the communication link and/or as an interruption of the control line DB between the main control device HE and the additional control device ZE. It can be especially useful to define a critical wait time duration TG as the upper limit for the watchdog supervision logic WD which is greater than the wait time or clock time WZ between two temporally consecutive switch-on commands in each case such as $P_{1,k}$, $P_{1,k+1}$. In FIG. 2 this upper limit TG for the wait time duration TG amounts to I times the clock time TZ between the cyclically consecutive switch-on commands, with I>1. If this critical wait time TG has been exceeded without a switch-on command having been received, the watchdog supervision logic detects or interprets this as an error and automatically switches off the heating device HZ1 of the sorption drying device STE. This autonomous automatic switch-off system of the additional control unit means that it is ensured in any event that the heating device HZ1 will be switched off. This is because, in the event of this interruption or fault on the control line DB it would no longer be possible for the additional control unit ZE to receive a switch-off command from the main control device HE. In this way it is reliably avoided that the heating device HZ1 continues to heat until such time as the sorption material ZEO in the sorption container would be set to impermissibly high heating-up temperatures.

Figure 3:
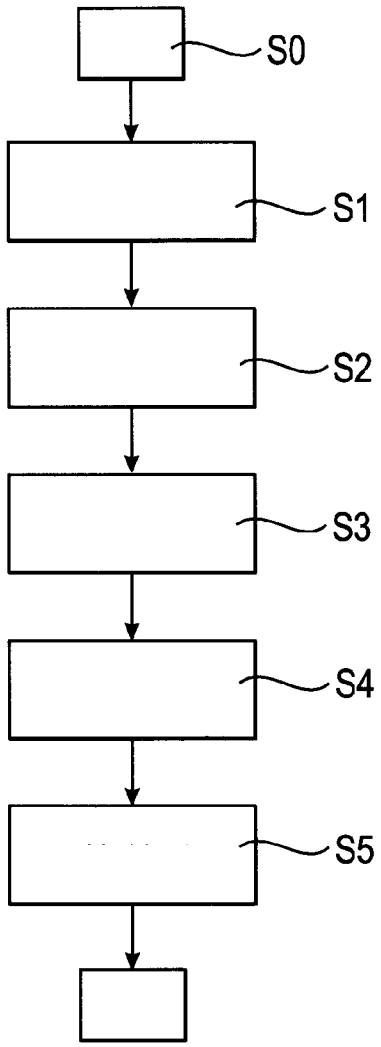
FIG. 3 shows in a schematic representation a flow diagram for a watchdog supervision unit in the additional control unit of FIGS. 1, 2.

FIG. 3 uses a flow diagram to illustrate how the control line DB between the main control device HE and the additional control unit ZE is supervised. The main control device HE transfers as from the start-up process, i.e. as from the start step S0 of the respective desorption process, a switch-on command in each case at periodic intervals WZ over the control line DB to the additional control unit ZE. Its watchdog supervision logic loads a safety timer in the subsequent step S1 and starts said timer in the next step S2. The watchdog supervision logic thus expects at defined intervals, i.e. wait times WZ, the arrival of a switch-on command such as $P_{1,0}$ to $P_{1,k+1}$ from the main control device HE. This is done in step S3 of FIG. 3. After the predetermined wait time WZ has elapsed, the watchdog supervision logic WD checks whether a switch-on command has arrived at the additional control unit ZE or not. If a switch-on command $P_{1,0}$ to $P_{1,k+1}$ has arrived, then the watchdog supervision logic WD loads and starts the clock WZ again through the timer in steps S1 and S2 as a supervision loop. If on the other hand the watchdog supervision logic establishes that, after the clock time WZ has elapsed, no switch-off command has been received, it switches off the safety timer in step S4. In the subsequent step S5 it ensures that the heating device HZ1 stops heating the sorption material ZEO. To this end it interrupts the energy supply to the heating device HZ1.

Figure 4:
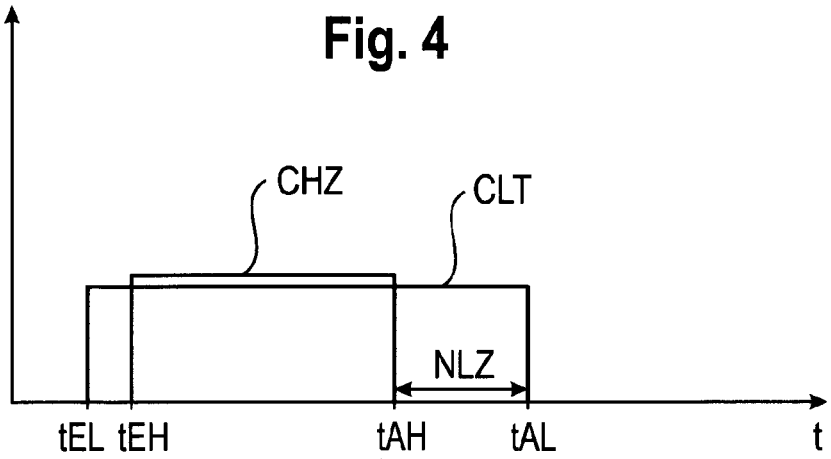
FIG. 4 shows in a schematic representation a switch-on/switch-off diagram for the heating device as well as the fan unit of the sorption drying facility of the dishwasher of FIG. 1 in the event of an error on the control line between the main control device and the additional control unit.

In order to avoid, despite the heating device HZ1 being switched off, its residual heat still being able to lead to an impermissibly high increase of the temperatures in the sorption material ZEO, it can be useful if necessary not to switch off the fan unit LT until after the heating device HZ1. The status diagram of FIG. 4 illustrates this. The timing of the switch-on state of the heating device HZ1 is designated by the curve CLT while the curve of the switch-on state of the fan unit LT is designated CHZ. The heating device HZ1 is switched on at time tEH in order to start a desorption process. As soon as the additional control unit ZE has registered an error on the control line DB with the aid of its watchdog supervision logic, the heating device HZ1 switches off at switch-off time tAH. Only after a prespecifable run-on time has elapsed does the additional control unit ZE also switch off the fan unit LT. The fact that the fan unit LT continues to blow an air flow LS2 through the sorption container SB with the sorption material ZEO even after the switch-off time tAH of the heating device, means that this maintained air flow transports heat energy out of the sorption container SB into the washing container SPB. In this way it is possible to avoid an upper temperature limit being exceeded as a result of the residual heat of the heating device HZ1 and/or of the sorption drying material ZEO in the sorption container SB even after the switch-off time tAH from which an impermissible material stressing of the sorption material would ensue. In this way the sorption material ZEO can still be handled in a manner which preserves the material even in the event of a fault.

The fan unit LT can be switched on again by the additional control unit ZE either before the switch-on time tEH for the heating device HZ1 or at the same time or slightly offset in time thereafter. Here in the exemplary embodiment of the FIG. 4 the fan unit LT is put into operation at time tEL before the switch-on time tEH of the heating unit HZ1.

Considered in general terms, in the event of an interruption or fault of the communication link between the main control device HE and the additional control device ZE, the heating device HZ1 would be switched off automatically for safety reasons by the additional control unit ZE, i.e. without further involvement of the main control device HE. In particular the heating device would be switched off within a critical wait time of a maximum 180 seconds after no switch-on command having been detected at the prespecified time. This prevents the heating device remaining active and continuing to heat in the event of an error.

Since the additional control electronics intervenes and switches off the heating advice if an error occurs on the control line and does not wait until a critical temperature upper limit has been reached, after which material damage or impermissible stresses on the sorption material would occur, the sorption material is treated in a manner which largely preserves it. This means that its reversibly dehydratable material properties are largely maintained over the product lifetime of the dishwasher.

Should the additional control unit ZE develop an error and there is no switching off of the heating device HZ1, for additional security against thermal overheating at least one electrical temperature protection unit SI can be provided directly in the sorption container SB as a thermal overheating protection device. This electrical temperature protection unit is inserted into at least one power supply line of the heating device HZ1. It comprises at least one electrical thermo switch and/or a cartridge fuse. Thus if the temperature at the housing of the sorption container SB exceeds an upper limit temperature, the electrical temperature protection unit SI interrupts at least one power supply line of the heating device HZ1. In this way double protection for switching off the heating device to prevent thermal overheating of the sorption material is provided.

The fact that the additional control unit already switches off the heating device HZ1 if an error occurs on the control line during a desorption process and does not wait until a critical limit temperature is exceeded in the sorption container, which would lead to an impermissible stressing of or even damage to the sorption material, means that the original reversibly dehydratable material properties of the sorption material are largely retained. Only if the additional control electronics ZE were not to switch off the heating device in the event of an error does the electrical temperature protection unit TSI on the sorption container SB intervene as a last resort and disconnect at least one power supply line for the heating device HZ1. This electrical temperature protection unit thus forms the second stage of a two-stage thermal protection for the sorption drying device TSE.

In a corresponding way for example to the respective desorption process, the control line DB from the additional control unit can also be monitored for the respective sorption process. In the event of an error it only switches off the fan unit LT which is running in this case since the heating device HZ1 is actually switched off during sorption.

If necessary the additional control unit ZE can also undertake supervision of a liquid heating device such as the continuous-flow heater for example. If a communication error, a transmission fault or interruption of the signal line from the main control device HE to the additional control device ZE occurs, the latter in this case also switches off this electrical component for the sake of safety before thermal damage can result.

If necessary the main control device HE can send a switch-off command to the additional control device ZE in order to switch off the one or more components of the sorption drying device, especially its heating device HZ1 and fan unit LT, if a critical limit temperature is exceeded in the interior of the washing container SPB of the domestic dishwasher GS and/or in the area of the sorption container SB of the sorption drying device. This provides a further thermal protection, especially during desorption operation of the sorption drying device STE. The temperature in the interior of the washing container SPB can be determined for example with the aid of at least one temperature sensor, which is typically attached to one of the side walls of the washing container SPB of the dishwasher. In FIG. 1 a temperature sensor on the side wall of the washing container SPB is connected via a measurement line ML to the main control device HE. In a corresponding manner, in addition to or independently thereof, the respective temperature in the area of the sorption container can be determined with the aid of at least one temperature sensor.

Considered in general terms, the additional control unit can switch off the sorption drying device, especially its heating device and/or fan unit, if a critical characteristic value, especially mains voltage fluctuation and/or mains frequency fluctuation of the electrical energy supply network to which the main control device and/or the additional control unit is effectively connected, is exceeded. This also safeguards the sorption drying device against any impermissibly high fluctuations from one or more characteristic values of the electrical energy supply network. In particular it can be ensured in this way, in the event of an impermissibly high overvoltage for example, that the heating facility is switched off before said facility outputs too much heat to the sorption material of the sorption container as a result of this overvoltage.

Expressed in more general terms, the additional control unit thus enables it to be ensured that impermissibly high heating of the sorption material in the sorption container of the sorption drying facility is largely avoided. In particular exceeding a critical limit temperature which would lead to damage to the sorption material is prevented. In this way it is ensured that the sorption material is only heated up by the heating device in a manner that preserves the material. In this way irreparable damage to the material is largely avoided.

The invention claimed is:

1. A domestic dishwasher, comprising:

a main controller;

a sorption drying device having electrical components including a fan and a heater; and an additional controller configured to specifically control the sorption drying device, the additional controller being functionally separate from the main controller, wherein the additional controller is configured to change the sorption drying device to a safe mode when a failure of the main controller is detected, and only after a predetermined run-on time has elapsed, the additional controller is configured to switch off the fan of the sorption drying device after the heater of the sorption drying device has been switched off.

2. The domestic dishwasher of claim 1, wherein the additional controller is a component of the main controller.

3. The domestic dishwasher of claim 1, wherein the additional controller is a separate functional component and spatially separated from the main controller.

4. The domestic dishwasher of claim 3, wherein the additional controller is spatially separated from the main controller by a predetermined spatial distance.

5. The domestic dishwasher of claim 3, wherein the additional controller is arranged at a minimum distance from the sorption drying device.

6. The domestic dishwasher of claim 1, further comprising:

a washing container having a base; and a base module below the base of the washing container;

wherein at least one of the main controller and the additional controller are accommodated in the base module below the base of a washing container.

7. The domestic dishwasher of claim 1, wherein the sorption drying device has a sorption container with reversibly dehydratable sorption material.

8. The domestic dishwasher of claim 1, further comprising a control line to connect the additional controller to the main controller.

9. The domestic dishwasher of claim 8, wherein the additional controller has watchdog supervision logic to check the functional integrity of the control line during activation of the sorption drying device in at least one of a respective sorption drying process and desorption process.

10. The domestic dishwasher of claim 9, wherein the main controller consecutively sends the watchdog supervision logic of the additional controller a plurality of switch-on commands over the control line.

11. The domestic dishwasher of claim 10, wherein the main controller cyclically repeats at least one of the plurality of switch-on commands.

12. The domestic dishwasher of claim 10, wherein the watchdog supervision logic of the additional controller has one of a clock and a timer which determines an upper limit for a wait time between respective receive clock times of each two consecutively-sent switch-on commands.

13. The domestic dishwasher of claim 12, wherein the watchdog supervision logic of the additional controller monitors whether the upper limit for the wait time without receipt of a next switch-on command is exceeded.

14. The domestic dishwasher of claim 13, wherein the additional controller switches off the heater if the watchdog supervision logic determines that the upper limit for the wait time without receipt of the next switch-on command is exceeded.

15. The domestic dishwasher of claim 9, wherein the watchdog supervision logic of the additional controller is configured to supervise the functional integrity of the control line if the heater is switched on for desorbing sorption material of the sorption drying device.

16. The domestic dishwasher of claim 1, further comprising a washing container; wherein the sorption drying device has a sorption container; and wherein the additional controller is configured to switch off the sorption drying device when a critical limit temperature is exceeded in at least one of the interior of the washing container and the area of the sorption container.

17. The domestic dishwasher of claim 16, wherein the additional controller is configured to switch off the heater when the critical limit temperature is exceeded in the at least one of the interior of the washing container and the area of the sorption container.

18. The domestic dishwasher of claim 16, further comprising a thermal protection unit disposed in the sorption container, wherein the thermal protection unit interrupts power to the sorption drying device when temperature in the sorption container exceeds an upper limit temperature.

19. The domestic dishwasher of claim 1, wherein the additional controller is configured to switch off the sorption drying device when a critical characteristic value of an electrical energy supply network, with which at least one of the main controller and the additional controller is actively connected, is exceeded in at least one of a respective sorption process and a desorption process.

20. The domestic dishwasher of claim 19, wherein the critical characteristic value is at least one of a main voltage deviation and a mains frequency deviation of the electrical energy supply network.

* * * * *